US005720598A

United States Patent [19]

de Chizzelle

[11] Patent Number: 5,720,598

[45] Date of Patent: Feb. 24, 1998

[54] METHOD AND A SYSTEM FOR EARLY DETECTION OF DEFECTS IN MULTIPLEX POSITIVE DISPLACEMENT PUMPS

[75] Inventor: Yan Kuhn de Chizzelle, Missouri City, Tex.

[73] Assignee: Dowell, a division of Schlumberger Technology Corp., Sugar Land, Tex.

[21] Appl. No.: 539,288

[22] Filed: Oct. 4, 1995

[51] Int. Cl.[6] ..... F04B 49/00

[52] U.S. Cl. ..... 417/53; 417/63

[58] Field of Search ..... 417/53, 63

[56] References Cited

U.S. PATENT DOCUMENTS

| | | | |
|---|---|---|---|
| 4,424,709 | 1/1984 | Meier, Jr. et al. . | |
| 4,523,901 | 6/1985 | Schippers et al. . | |
| 4,705,459 | 11/1987 | Buisine et al. . | |
| 5,039,279 | 8/1991 | Natwick et al. . | |
| 5,251,151 | 10/1993 | Demjanenko et al. . | |
| 5,257,912 | 11/1993 | Oakley et al. | 417/53 X |
| 5,332,366 | 7/1994 | Anderson | 417/53 |
| 5,388,965 | 2/1995 | Fehn | 417/63 |

OTHER PUBLICATIONS

Cecil R. Sparks & J. C. Wachel, "Pulsations In Liquid Pumps And Piping Systems", Proceedings of the Fifth Turbomachinery Symposium, pp. 55–58, 61.

P. Cooper, "Pumping Machinery—1989", The Third Joine ASCE/ASME Mechanics Conference, University of California, San Diego, Jul. 9–12, 1989, pp. 83–89.

*Primary Examiner*—Richard E. Gluck
*Attorney, Agent, or Firm*—John E. Vick, Jr.

[57] ABSTRACT

A method and a system for the early detection of defects in at least one multiplex pump, which includes a plurality of cylinders or chambers, by determination and analysis of pump harmonics based upon pressure fluctuations in a line in fluid communication with the multiplex pump and multiplex pump frequency. The presence of a defect, the type defect, and specific pump unit having the defect, is determined.

64 Claims, 8 Drawing Sheets

METHOD AND A SYSTEM FOR EARLY DETECTION OF DEFECTS IN MULTIPLEX POSITIVE DISPLACEMENT PUMPS

FIELD OF THE INVENTION

This invention relates to the early detection of defects in a multiplex positive displacement pump by determining and analyzing pump harmonics derived from pressure recordings at the inlet or outlet of the pump. The pump harmonics are indicative of the existence of defects, the type of defect, and the particular defective chamber in a multiplex positive displacement pump.

DESCRIPTION OF PRIOR ART

Multiplex pumps, which include a plurality of chambers, have been used extensively for many years for pumping high volumes of fluids at high pressure. These pumps are of the "positive displacement" type; that is they move fluid by a positive displacement mechanism and generate a discharge stream having pressure fluctuations resulting from the positive displacement action of the pump. Multiplex pumps include, but are not limited to, plunger-and-cylinder pumps, diaphragm pumps, gear pumps, external circumferential piston pumps, internal circumferential piston pumps, lobe pumps, and the like.

While all of these positive displacement multiplex pump types are used for various applications, the most frequently used multiplex pump in the oil field industry is the plunger-and-cylinder pump. The plungers in these pumps are usually driven by a common drive shaft or gearing so that the entire pump operates at a single frequency (RPM). The separate plunger-and-cylinder assemblies are formed as an integral part of the multiplex pump and are commonly referred to and will be referred to herein as cylinders. The variable volume chambers used in other types of positive displacement pumps are referred to herein as chambers.

These types of multiplex pumps are well known to the art and are widely used for fracturing, cementing, drilling, chemical additive pumping systems, water control, well acidizing, and the like. The pump requirements for operations of this type include a requirement for high reliability and continuous high volume and high pressure fluid flow.

One application which is particularly demanding is fracturing. In fracturing operations a fluid is pumped down a wellbore at a flow rate and pressure sufficient to fracture a subterranean formation. After the fracture is created or, optionally, in conjunction with the creation of the fracture, proppants may be injected into the wellbore and into the fracture. The proppant is a particulate material added to the pumped fluid to produce a slurry. Pumping this slurry at the required flow rate and pressure is a severe pump duty. In fracturing operations each pump may be required to pump up to twenty barrels per minute at pressures up to 20,000 psi. The pumps for this application are quite large and are frequently moved to the oil field on semi-trailer trucks or the like. Many times a single multiplex pump will occupy the entire truck trailer. These pumps are connected together at the well site to produce a pumping system which may include several multiplex pumps. A sufficient number of pumps are connected to a common line to produce the desired volume and pressure output. Some fracturing jobs have required up to 36 pumps.

Since fracturing operations are desirably conducted on a continuous basis, the disruption of a fracture treatment because of a pump failure is very undesirable. Further, when such massive pumps are used, it is difficult in some instances to determine, in the event of a pump failure, which pump has failed. Because of the severe pump duty and the frequent failure rate of such pumps, it is normal to take thirty to one hundred percent excess pump capacity to each fracture site. The necessity for the excess pump capacity requires additional capital to acquire the additional multiplex pumps and considerable expense to maintain the additional pumps and to haul them to the site. Presently, multiplex pumps are frequently disassembled and inspected after each fracture treatment and, in some instances, routinely rebuilt after each fracture treatment in an attempt to avoid pump failures during subsequent fracture treatments.

In fracturing and other uses for multiplex pumps, it is highly desirable that a method be available for determining, in advance, when pumps are defective so that pump failures during operations can be avoided. It would also be desirable in the event of a failure to be able to determine quickly, when a plurality of multiplex pumps are connected to a common line, which of the multiplex pumps is defective. Accordingly, continuing efforts have been directed to the development of methods and systems for early detection of pump failure in multiplex positive displacement pumps.

SUMMARY OF THE INVENTION

According to the present invention, early detection of defects in multiplex positive displacement pumps in a pumping system, comprising at least one multiplex pump in fluid communication with a suction or a discharge line, is accomplished by a method comprising measuring pressure fluctuations in the line as a function of time and the pump frequency and determining pump harmonics of the pump from the pressure fluctuations and the pump frequency in the frequency domain, with the pump harmonics being indicative of pump defects in the pump.

The method of the present invention is particularly adapted to multiplex pump systems comprising plunger-and-cylinder chambers.

If the first harmonic (fundamental harmonic) refers to the harmonic corresponding to the pumping frequency of the pump, the presence of only the Ni harmonics, where N is equal to the number of cylinders or chambers in the multiplex pump and i is an integer, is indicative of no defects in the multiplex pump. The presence of harmonics other than the Ni harmonics is indicative of defects in the multiplex pump. The relative amplitude of these harmonics is indicative of the severity of the defect.

The method of the present invention also includes determining the phase angle of the multiplex pump harmonics to enable the determination of the reference angle of the first and other pump harmonics. The reference angle of the first harmonic is indicative of which cylinder in the multiplex pump is defective and of the type of defect. The reference angles of other pump harmonics are indicative of the type of defect.

The present invention further includes a system for early detection of defects in multiplex positive displacement pumps comprising a pressure sensor in pressure sensing communication with a line in fluid communication with a multiplex pump, a tachometer in frequency sensing communication with said pumps, a computer in signal recording communication with the pressure sensor and the tachometer and programed to determine pump harmonics in a frequency domain for the multiplex pump from pressure fluctuations in the line measured by the pressure sensor, and a display device adapted to display an indication of pump defects based on the pump harmonics and pump frequency.

The present invention further includes an improvement in a method for fracturing a subterranean formation wherein the improvement comprises measuring pressure fluctuations in a line in fluid communication with a multiplex pump system, determining pump harmonics based upon the pressure fluctuations and pump frequency and generating at least one signal indicative of pump defects.

The method and system of the present invention is useful with positive displacement multiplex pumps generally for applications such as fracturing, cementing, drilling, chemical additive systems, water control pump systems, well acidizing jobs, and the like.

The present invention accomplishes the detection of defects in multiplex positive displacement pumps at an early stage before the pump actually fails. This permits the testing of multiplex pumps prior to initiation of pumping operations and increases the reliability of the pumps used for fracturing jobs and the like, and reduces the need for excess pump capacity. Furthermore, the ability to detect defects at an early stage by a method which can be utilized throughout the fracturing treatment permits the identification of pumps which have developed defects at the end of a fracturing treatment. This greatly reduces unnecessary pump maintenance by identifying those pumps which require maintenance.

DESCRIPTION OF PREFERRED EMBODIMENTS

In the discussion of the Figures, the some numbers will be used throughout to refer to the some or similar components.

Figure 1:
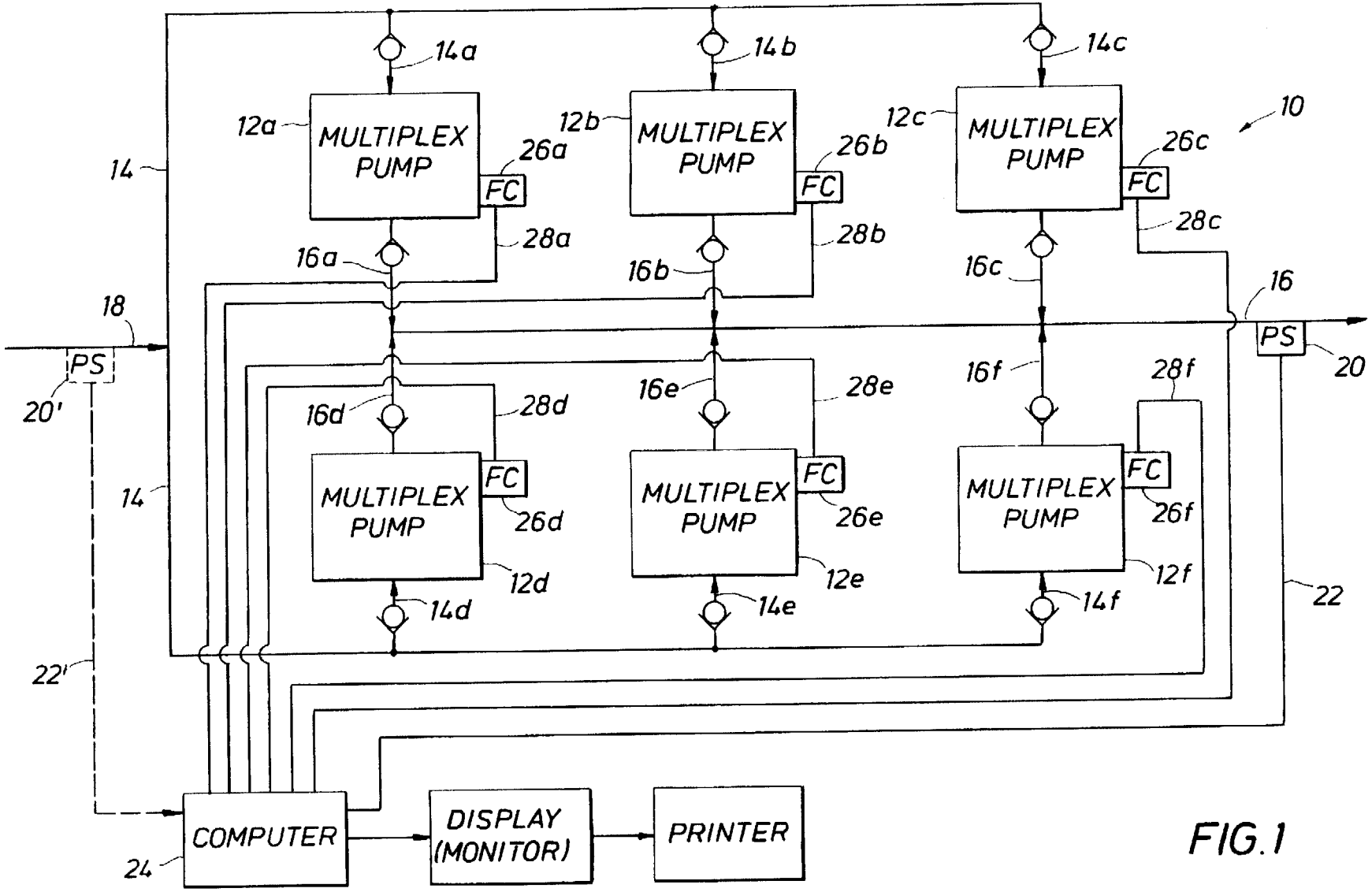
FIG. 1 is a schematic diagram of a pumping system which comprises a plurality of multiplex positive displacement pumps arranged for use in a well fracturing treatment.
Figure 1A:
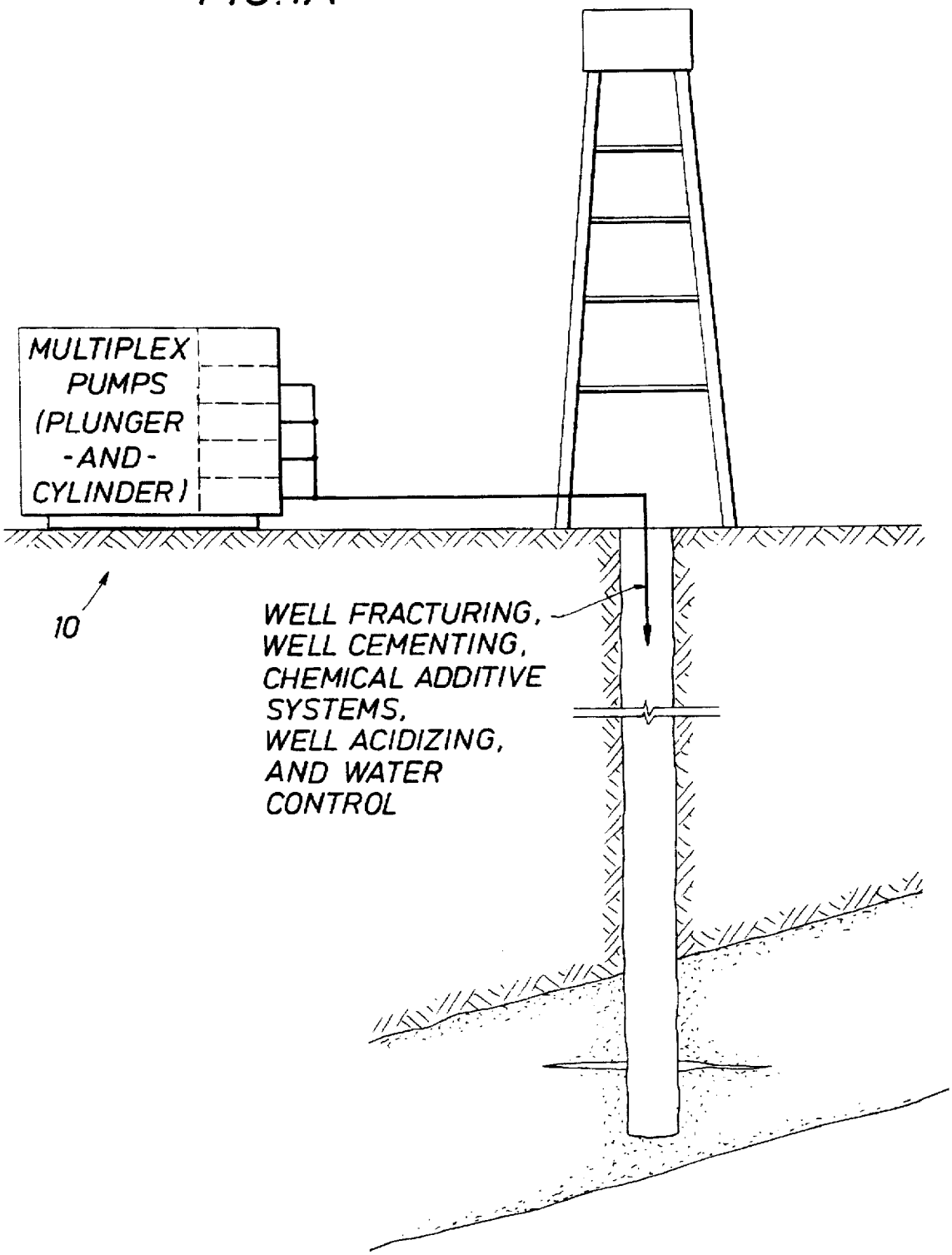
FIG. 1A is a schematic diagram of a pumping system used for a variety of well treatment applications.

In FIG. 1 a pumping system 10 is shown which comprises six triplex pumps 12*a–f*. A suction manifold line 14 supplies fluid through a plurality of inlet conduits 14*a–f* to the triplex pumps 12*a–f*, respectively. The pumps 12*a–f* discharge through a discharge line 16 via a plurality of outlet conduits 16*a–f*, respectively. A line 18 supplies fluid to the manifold 14. A pressure sensor 20 is positioned in pressure sensing communication with the discharge line 16 to measure pressure fluctuations in the line 16 as a function of time and in communication via a cable 22 with a computer 24. The pressure sensor 20 is capable of sensing pressure fluctuations in the line 16 at a sensing frequency equal to at least the pump frequency (revolutions per second), and preferably at at least 100 Hz for fracturing applications. The sensor 20 may be of any suitable type pressure sensor known to the art, such as a VIATRAN, Pressure Transducer, Model 509, marketed by Viatran Corporation. The pressure sensor signal is recorded in real time at at least the pump frequency and preferably at at least 100 Hz through either the computer 24 or a spectrum analyzer. The frequency of each pump 12*a–f* in revolutions per time unit, i.e., revolutions per minute, revolutions per second and the like, is measured by a tachometer or frequency counter referred to herein as a tachometer. A plurality of tachometers 26*a–f* are shown schematically in frequency sensing communication with the pumps 12*a–f*, respectively, with the tachometers 26*a–f* being in communication with the computer 24 via a plurality of cables 28*a–f*. The computer 24 or spectrum analyzer processes the pressure sensor signal and the frequency signal, converts the signals to the frequency domain, and displays the pump harmonics for observation by the operator. The term "computer," as used herein, may include a spectrum analyzer which is a special purpose instrument programmed to convert time signals into frequency signals for display. Alternatively, a pressure sensor 20' could be placed in operative communication with the inlet line 18 to sense pressure variations in inlet line 18 and in communication with the computer 24 via a cable 22'. Either the pressure fluctuations in the inlet line 14 or the pressure fluctuations in the discharge line 16 can be used to determine pump harmonics for the multiplex pumps 12*a–f*. Alternatively, pressure fluctuations in the discharge line may be measured in the outlets 16*a–f*, and pressure fluctuations for the inlet line may be measured in the inlets 14*a–f*.

In fracturing operations, a number of the multiplex pumps 12*a–f* are used to produce the required flow volume at the required pressure for the fracturing treatment. Usually only a portion of the triplex pumps 12*a–f* are used to produce the desired flow volume at the desired pressure. If one of the pumps 12*a–f* initially used to supply the desired pressure and volume becomes inoperative, a different pump is placed into service by engaging the added pump. Similar pump systems may also be used for other oil field operations.

A single pressure sensor 20, the tachometers 26*a–f*, and the computer 24 may be used to identify pump harmonics for each multiplex pump 12*a–f*. As discussed previously, triplex pumps are commonly used for such operations and the invention will be discussed primarily by reference to triplex pumps (three cylinders), although multiplex pumps having 2, 3, 4, 5 or more cylinders can be used. The invention will also be discussed by reference to plunger-and-cylinder pumps although other types of positive displacement pumps, such as diaphragm pumps, gear pumps, external circumferential pumps, internal circumferential pumps, lobe pumps, and the like, can also be used.

The pump harmonics are readily determined by transforming the pressure fluctuations in the time domain into the frequency domain utilizing any of a number of mathematical transforms known to the art. Some such transforms include the Continuous Fourier transform, the Discrete Fast Fourier transform, the Hilbert transform, the Laplace transform, the Maximum Entropy Method, and the like. The Fourier transform, and particularly the Fast Fourier transform, are preferred because they are more readily adapted to computer processing. The use of such transforms to convert pressure fluctuations in the time domain to the frequency domain is well known to those skilled in the art. Such conversions can readily be made on computers using a variety of programing such as, for instance, the Lab Windows Program marketed by the National Instruments Corporation. A standard off-the-shelf spectrum analyzer can also be used to observe the signals in the frequency domain, such as those marketed by the Hewlett Packard Corporation.

Figure 2:
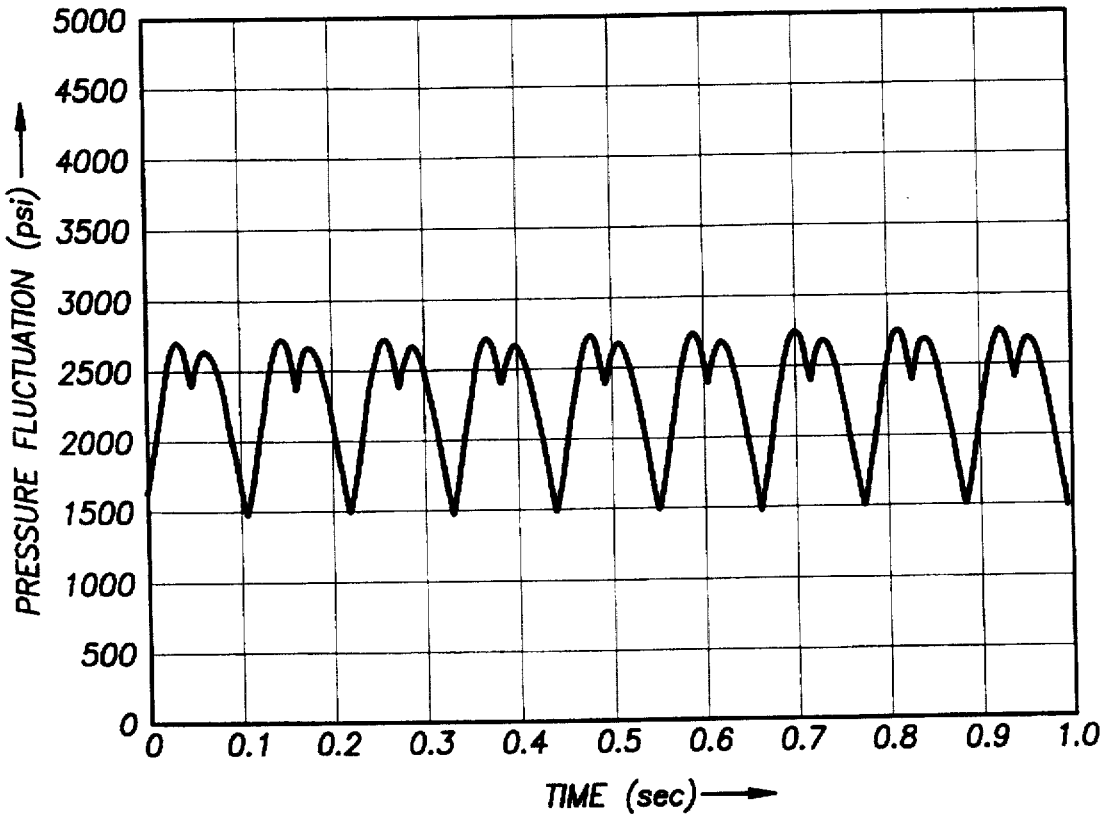
FIG. 2 is a graph of calculated pressure fluctuations as a function of time in a discharge line from a triplex pump (three-cylinder) which is operating properly.
Figure 3:
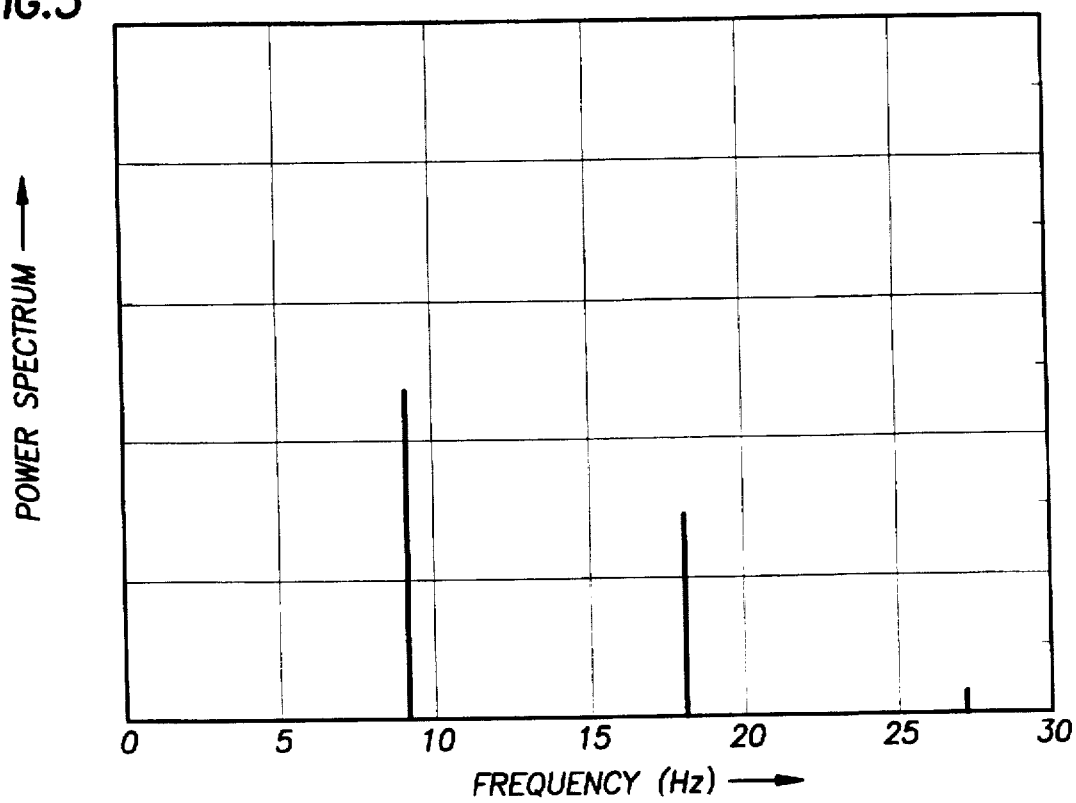
FIG. 3 is a graph of pump harmonics in the frequency domain based upon the pressure fluctuations shown in FIG. 2.

FIG. 2 is a graph showing calculated pressure fluctuations as a function of time for one of the pumps 12*a–f*, which is shown as a properly functioning triplex pump having an eight inch stroke and a five inch diameter plunger, and pumping at a frequency of 3 Hz (revolutions per second) corresponding to a pumping rate of 8.7 barrels per minute. The pressure fluctuations from the pump shown in FIG. 2 are transformed into the frequency domain and are shown as pump harmonics in FIG. 3. The first harmonic corresponds to the frequency of the pump (3 Hz) and is referred to as the fundamental frequency ($f_o$). The second harmonic is at twice the pump frequency and the third harmonic is at three times the pump frequency. In the case of a normally working triplex pump as shown in FIG. 3, the first and second harmonics are not apparent, and the first frequency spike which will be observed will be found at three times the fundamental frequency or at the third harmonic. The third harmonic is shown in FIG. 3 at a frequency of 9 Hz, and no other harmonics are shown for frequencies less than 9 Hz. Additional harmonics are shown at multiples of the third harmonic, i.e., at the sixth harmonic and ninth harmonic. The sixth harmonic is shown at a frequency of 18 Hz, and the ninth harmonic is shown at a frequency of 27 Hz. A normally working triplex pump will not exhibit spikes at the first and second harmonic, the fourth and fifth harmonic, the seventh and eighth harmonic, and the like. The same information can be obtained from the higher harmonics as from the first, second and third harmonics. It is noted that when a multiplex pump having two, three, four or five cylinders is used, the second, third, fourth and fifth harmonics, respectively, would be the first harmonic shown for these pumps in normal operation.

Figure 4:
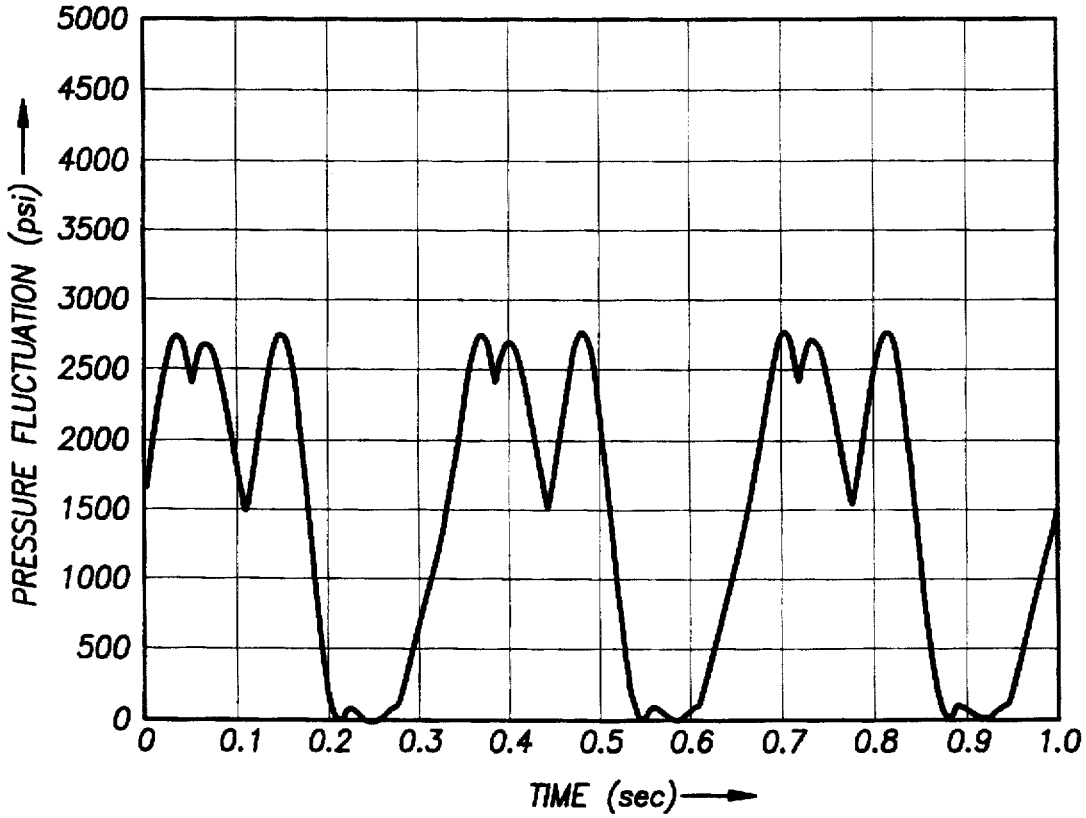
FIG. 4 is a graph of calculated pressure fluctuations as a function of time in a discharge line from a triplex pump which has a bad discharge valve with one hundred percent (100%) flow leakage in one of the cylinders.
Figure 5:
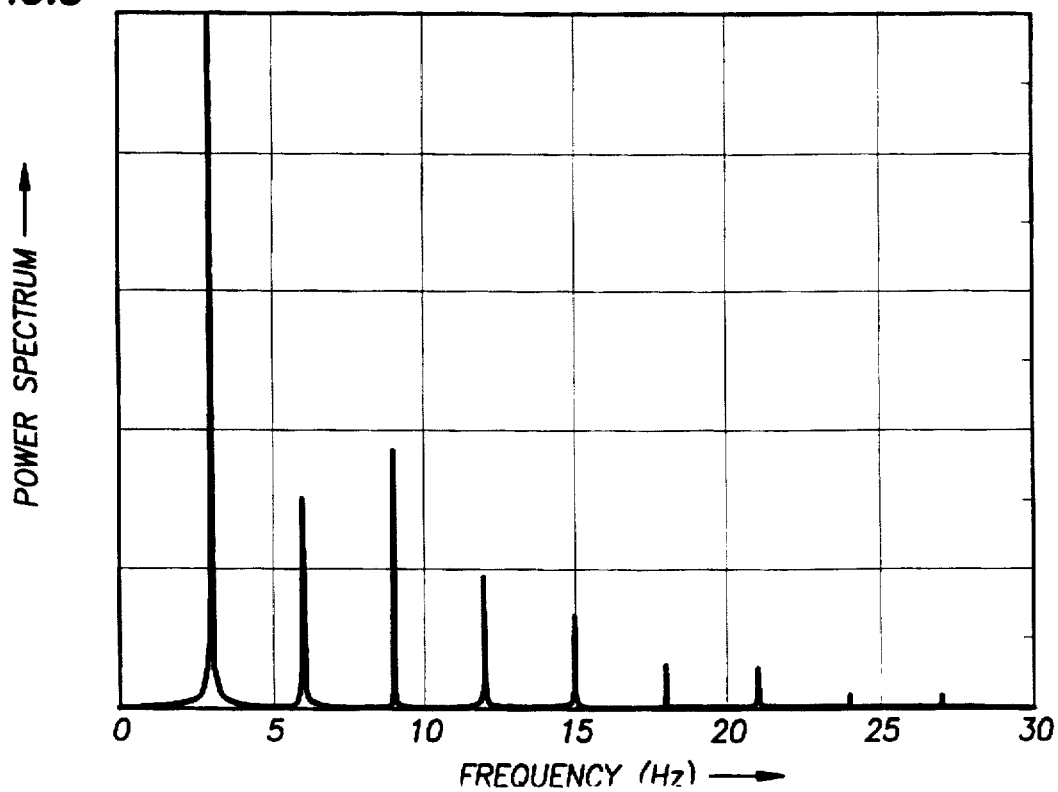
FIG. 5 is a graph of the pump harmonics for the pump of FIG. 4.

In FIG. 4 a graph of calculated pressure fluctuations in the discharge line as a function of time is shown for the pump of FIG. 2 with a defective discharge valve with one hundred percent (100%) flow leakage in one cylinder. FIG. 5 shows the corresponding pump harmonics. The third, sixth and ninth harmonic spikes are shown at a frequencies of 9 Hz, 18 Hz and 27 Hz, respectively, with the first and second harmonic spikes being shown at frequencies of 3 Hz and 6 Hz respectively. The presence of the first and second, the fourth and fifth and the seventh and eighth harmonic spikes is indicative of a pump defect.

EXAMPLE

Figure 6:
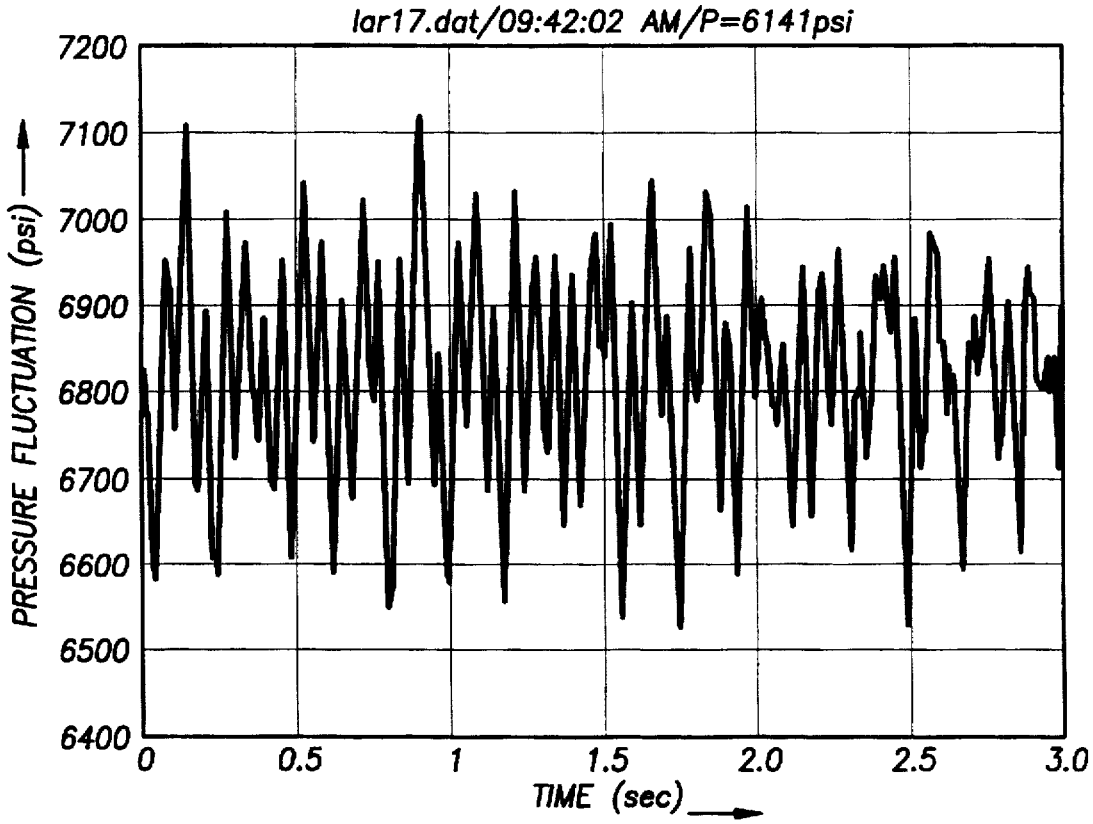
FIG. 6 is a graph of pressure fluctuations as a function of time in a discharge line from the three triplex pumps discussed in the example.
Figure 7:
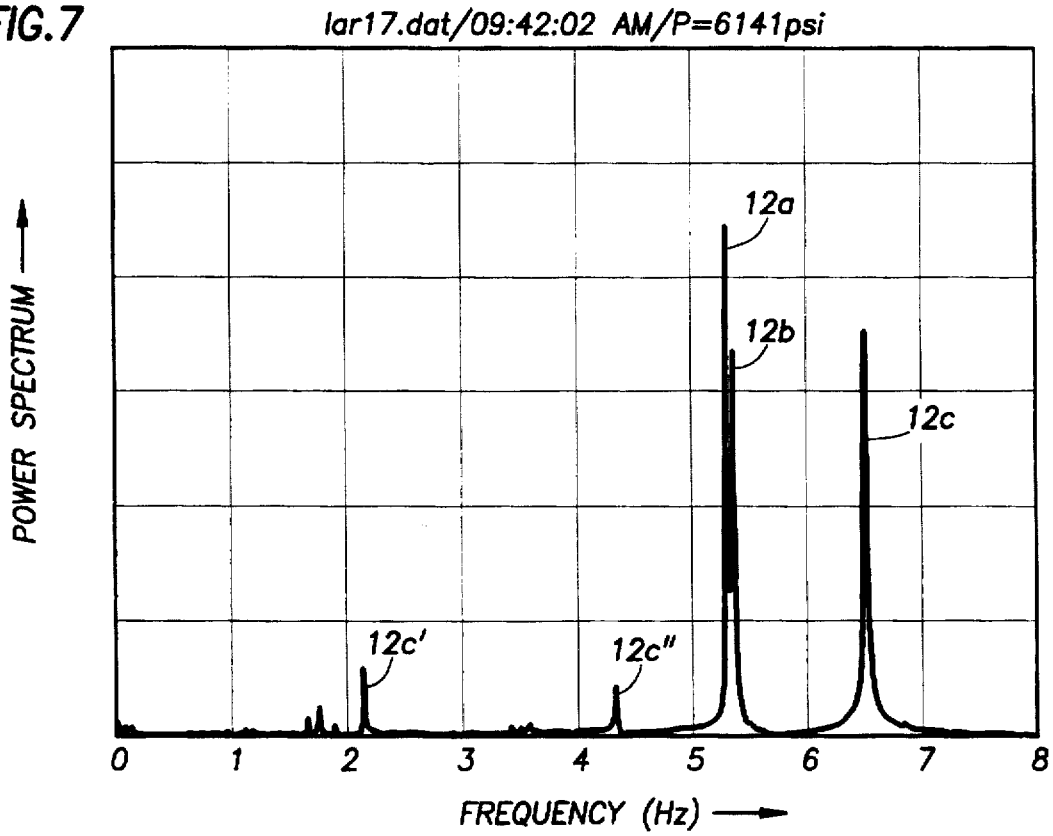
FIG. 7 is a graph of the pump harmonics in the frequency domain for the three pumps in the example based upon the pressure fluctuations shown in FIG. 6.

A pumping system consisting of three triplex pumps 12*a*, 12*b* and 12*c* with HOPI type fluid ends, an eight-inch stroke and a five-inch diameter plunger discharging into a common discharge line, was monitored at 100 Hz for pressure fluctuations as a function of time in the discharge line during an actual fracturing job. The recorded pressure fluctuations are shown in FIG. 6. The data in FIG. 6 was taken at 9:42:02 a.m. on the date of the test. The pump harmonics corresponding to the data shown in FIG. 6 are shown in FIG. 7 in the frequency domain. Since the pumps 12*a*, 12*b* and 12*c* were running at slightly different frequencies, the harmonic spikes do not coincide, which allows identification of the harmonic spikes for each pump. The third harmonic spikes for the pumps 12*a*, 12*b* and 12*c* are shown by numerals 12*a*, 12*b* and 12*c*, respectively, in FIG. 7, FIG. 8 and FIG. 9. The triplex pump 12*c* displays both a small first harmonic spike 12*c*' and a second harmonic spike 12*c*" which are indicative of a defect in the triplex pump 12*c*. The triplex pumps 12*a* and 12*b* show no first or second harmonic spikes and are pumping normally.

Figure 8:
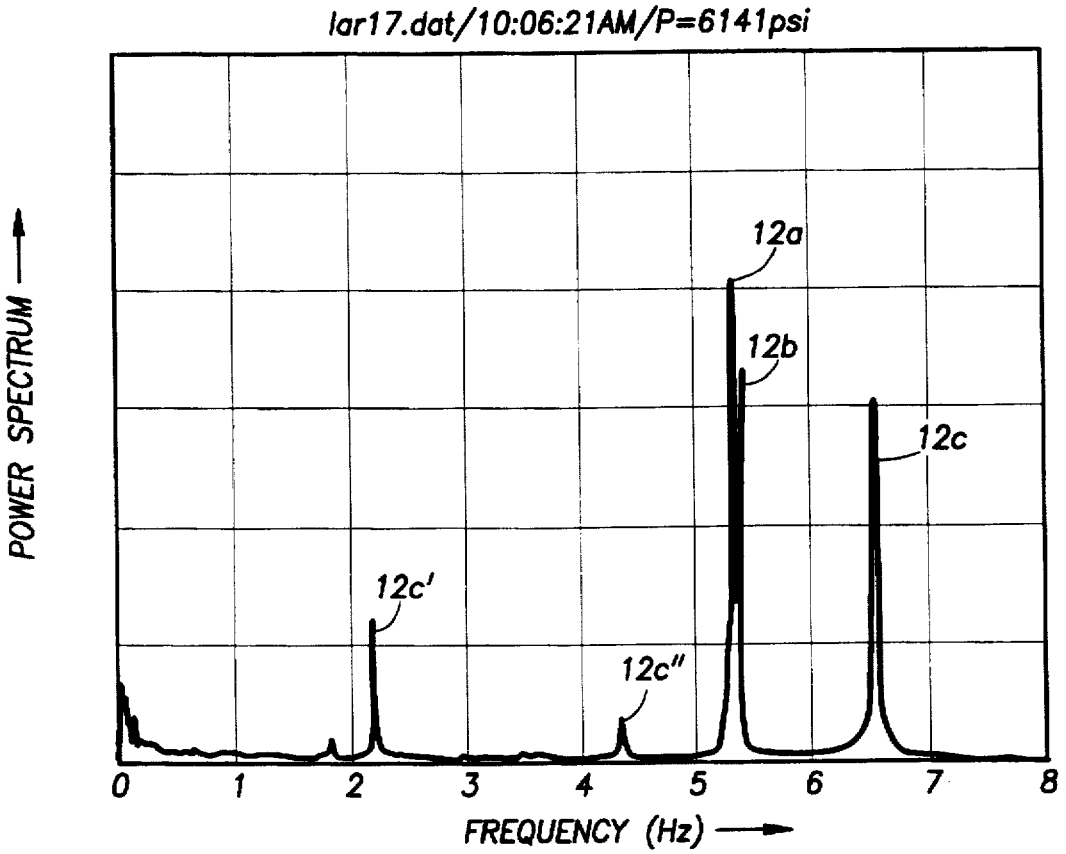
FIG. 8 is a graph of the pump harmonics for the three pumps in the example at a time approximately twenty-four minutes later than the pump harmonics shown in FIG. 7.

FIG. 8 shows the pump harmonics on the same fracturing job at 10:06:21 a.m. on the test date, i.e., about 24 minutes later. The first and second harmonic spikes for the pump 12*c* have grown and the third harmonic has shrunk, indicating that the problem has gotten worse. At the time the data in FIG. 7 and FIG. 8 were taken, there was no apparent indication to the pump operator that pump 12*c* was defective.

Figure 9:
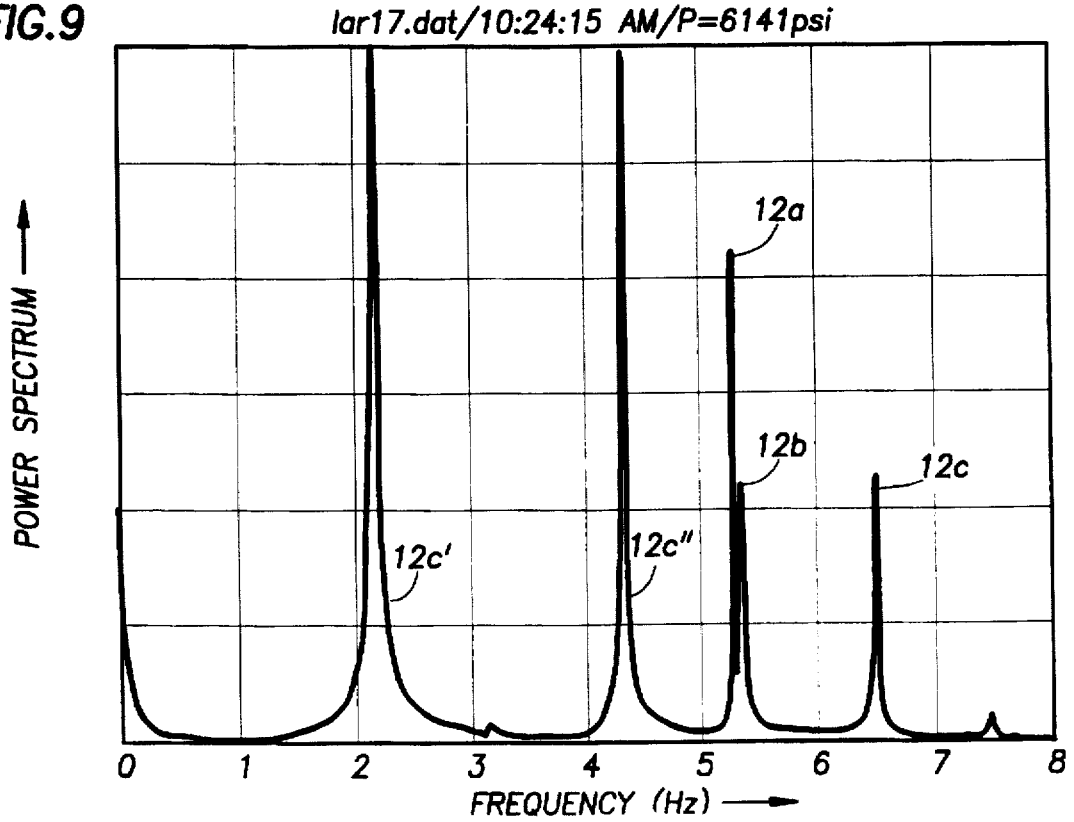
FIG. 9 is a graph of the pump harmonics for the three pumps in the example at a time approximately forty-two minutes later than the pump harmonics shown in FIG. 7.

The pump harmonics shown in FIG. 9 are for the same pumps shown in FIG. 6 but at 10:24:15 a.m. on the test date, i.e., about 42 minutes later. The pump 12*c* displays a prominent first harmonic spike 12*c*' and a prominent second harmonic spike 12*c*". The pump 12*c* had operated for about 42 minutes after initial detection of the defect before reaching the condition reflected in FIG. 9.

When the data in FIG. 9 was taken, the pump 12*c* was sufficiently defective that the entire pumping system was vibrating severely and it was still difficult to determine, without the present invention, which of the three pumps was defective and responsible for the vibration in the system. The advance notice that the pump 12*c* was defective 42 minutes before it became sufficiently defective to disrupt the entire pumping operation is sufficient time to permit a switch to an alternate pump or, depending upon the stage of the well treatment, to stop the well fracture treatment and repair the pump 12*c* or to complete the well fracture treatment before the pump 12*c* becomes unusable.

This example demonstrates the effectiveness of the present invention for the early detection of defects in multiplex pumps.

As shown in this example, the size of the first and second harmonic spikes increases as the problem worsens. The method of this invention can be further refined to quantify the amount of defectiveness of a pump, which can be stated in terms of flow leakage through the defective valve. The percentage flow leakage through the defective valve is related to the amplitude of a harmonic peak relative to the amplitude of the $N^{th}$ harmonic peak (where N is the number of cylinders in the pump). When the amplitude of the $i^{th}$ harmonic peak is $A_i$, where i is an integer which is not equal to N or a multiple thereof, then the relative amplitude of the $i^{th}$ peak is defined by the equation: $R_i=A_i/A_N$. $R_i$ is indicative of the well-being of a pump. Larger values of $R_i$ are indicative of the amount of leakage through the valve. FIG. 11 and FIG. 12 show computed values of $R_i$ for the first, second, fourth, fifth and sixth harmonics versus the percentage of flow leakage through a valve, in the case of the same triplex pump model shown in the example. The computed values assumed that only one valve was defective (a defective suction valve in FIG. 10 and a defective discharge valve in FIG. 11). These Figures show that as the amount of leakage increases (i.e., the problem in the pump becomes worse), the values of $R_1$, $R_2$, $R_4$, and $R_5$ increase. This information allows the pump operator to quantify the amount of leakage through a valve, and better estimate the time left to complete failure of the pump. This method also detects improperly primed cylinders or leaking plunger packing seals. Both of these failures would appear with the same symptoms as a defective suction valve. References to defective suction valves include these failures.

Another powerful advantage of this invention is the ability to determine which valve is defective (suction or discharge) and which cylinder includes the defect. By transforming the time pressure data into the complex frequency domain using a Fourier Transform and the like, each pump harmonic has a phase angle $\alpha$ varying from −180 to +180 degrees. $\alpha_i$ is defined as phase angle of the $i^{th}$ harmonic of the pump. The phase of the first harmonic is defined by equation 1:

$$\alpha_1=\theta_1+\alpha_o \qquad \text{(Equation 1)}$$

where $\alpha_1$ is the phase angle of the first harmonic and $\theta_1$ is a reference angle which is indicative of which of the pump cylinders is defective and $\alpha_o$ is the phase angle of the pump at the beginning of the pressure recording trace, relative to a particular position (typically chosen as the Bottom Dead Center position on cylinder 1).

Because the higher pump harmonics are located at frequencies which are multiples of the first harmonic, the $i^{th}$ phase angle $\alpha_i$ is related to the first phase angle $\alpha_1$ by the equation:

$$\alpha_i=i\alpha_1+\theta_i \qquad \text{(Equation 2)}$$

where $\theta_i$ is a reference angle which is indicative of the type of defect in the pump (discharge or suction valve).

Equation 2 can be re-written as:

$$\theta_i=\alpha_i-i\alpha_1 \qquad \text{(Equation 3)}$$

to determine the reference angle $\theta_i$.

$\theta_i$ is not a function of which cylinder is defective, but is indicative of the type defect, i.e., suction valve or discharge valve where i is greater than 1. $\theta_1$ is indicative of both the type defect and which cylinder contains the defect.

Figure 10:
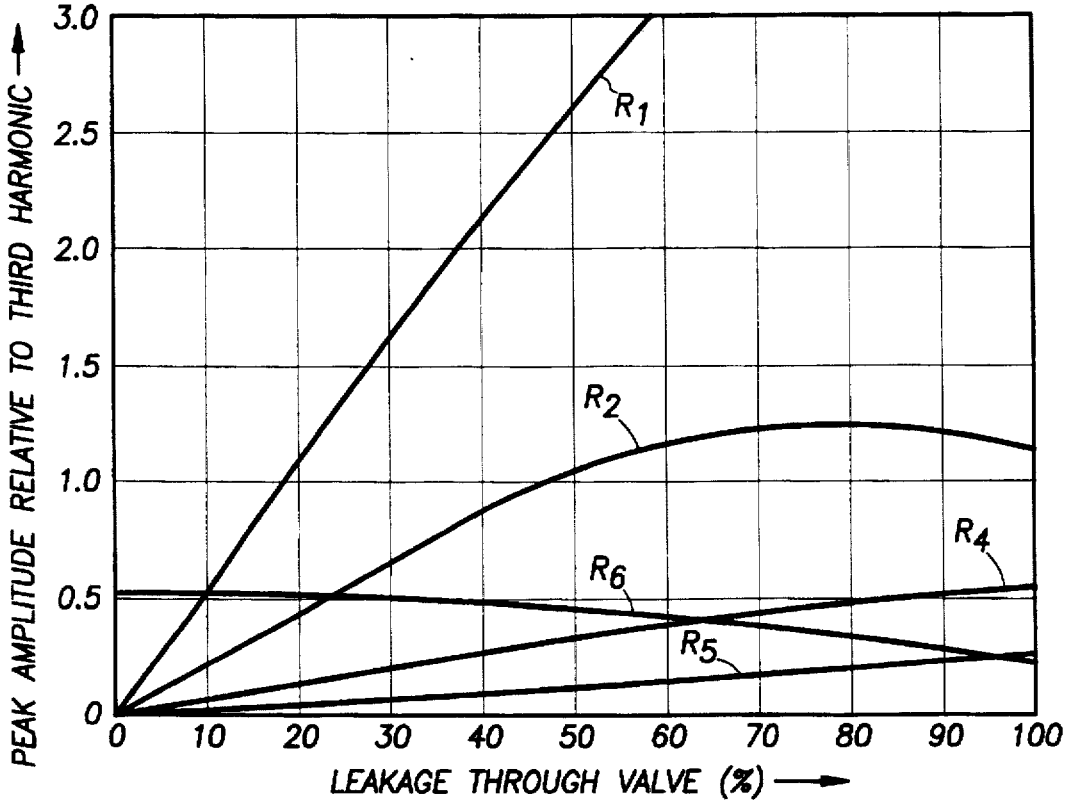
FIG. 10 is a graph of the calculated relative amplitude of the harmonics (Ri) relative to the third harmonic for a triplex pump having a defective suction valve.
Figure 11:
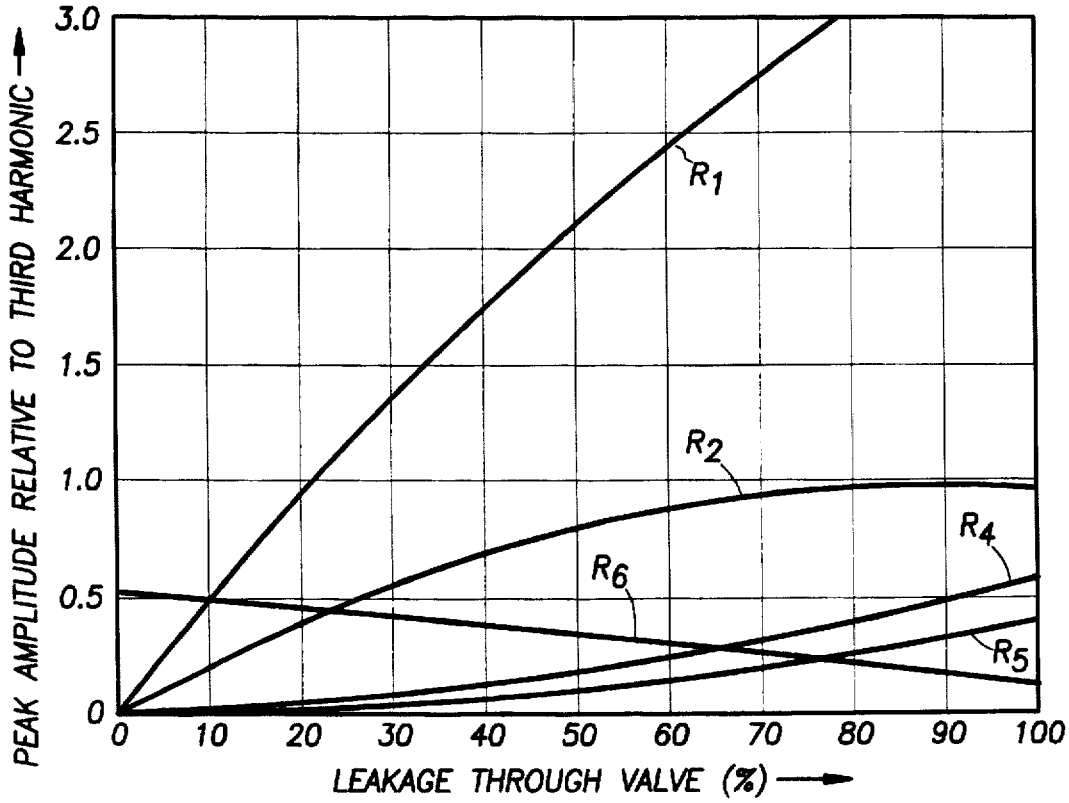
FIG. 11 is a graph of the calculated relative amplitude of the harmonics (Ri) for a triplex pump having a defective discharge valve.
Figure 12:
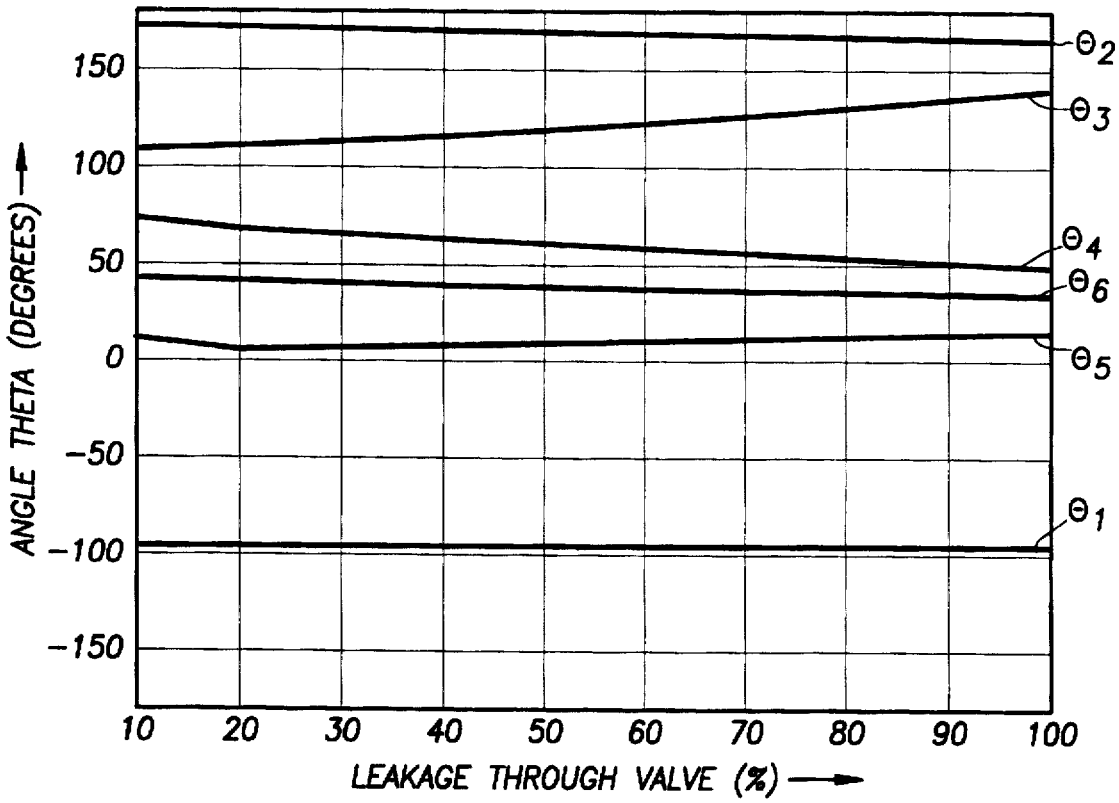
FIG. 12 is a graph of the reference angle ($\theta_i$) of the first six harmonics for a triplex pump having a defective suction valve vs. the percent leakage through the valve; and, FIG. 13 is a graph of the reference angle ($\theta_i$) of the first six harmonics for a triplex pump having a defective discharge valve vs. the percent leakage through the valve.
Figure 13:
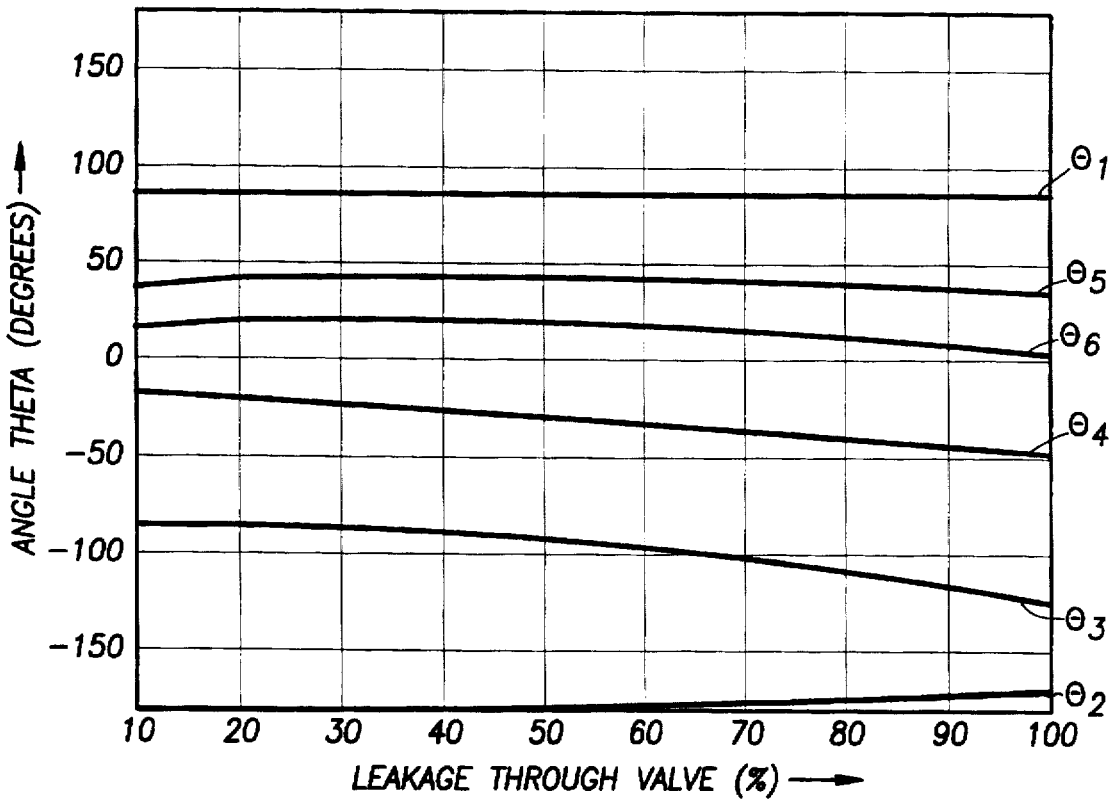

FIG. 12 and FIG. 13 show the computed values of the reference angle for the first six pump harmonics (i=1 through 6) versus the percentage of leakage through the valve of the same triplex pump as presented in FIG. 10 and FIG. 11. FIG. 12 shows the case of a defective suction valve (or lack of priming, or leaking cylinder packing), and FIG. 13 that of a defective discharge valve. For this computation, the frequency transform used is a discrete Fourier Transform, such as the one disclosed in *Numerical Recipes in C*, William H. Press, et al., Cambridge University Press, p. 406, 1988.

From FIG. 12 and FIG. 13, the values of $\theta_i$ are different in the case of a defective discharge (FIG. 12) or suction valve (FIG. 13). Furthermore, these values do not vary substantially with respect to the percent of leakage of the valve, thus making this technique of identifying which valve is defective extremely robust. The average values of $\theta_i$ are presented in degrees in Table 1. The values shown in Table 1 are values calculated for the multiplex pump system shown in the example.

TABLE 1

Reference Angles for the First Six Harmonics

| Reference Angle | Defective Suction Valve | Defective Discharge Valve |
|---|---|---|
| $\theta_1$ (defective cylinder 1) | −95 | +90 |
| $\theta_1$ (defective cylinder 2) | +25 | −150 |
| $\theta_1$ (defective cylinder 2) | +145 | −30 |
| $\theta_2$ | +170 | −179 |
| $\theta_3$ | +120 | −110 |
| $\theta_4$ | +55 | −30 |
| $\theta_5$ | +0 | +39 |
| $\theta_6$ | +39 | +10 |

$\theta_1$ will be the quantity used to determine which cylinder is defective. While $\theta_2$, $\theta_3$, $\theta_4$, $\theta_5$ and $\theta_6$ could all be used to determine whether the defect is in the suction or discharge valve, $\theta_3$ is the reference angle which is the most indicative, with 130° angle difference between the suction and discharge case, of whether the defect is in the suction or discharge valve.

The calculations above have demonstrated the detection, identification of the type defect, quantification of the amount of leakage, and identification of the cylinder containing the defect for triplex pumps. Similar calculations provide the same information for pumps having a different member of cylinders and for other types of multiplex pumps having multiple chambers.

During fracturing operations, proppant may be pumped into the well. This represents a particulate constituent in the pumped fluid. After the fracture has been opened, and while continuing to inject fluid (clear fluid) at fracturing volume and pressure, proppant is added to the fluid and injected into the well. The proppant is injected into the fracture to fill the fracture, and hold the fracture open, or at least maintain a permeable zone through the formation. During fracturing operations, while not desirable, the operation can be discontinued without harm to the well or formation during the clear fluid injection. It is much more difficult to interrupt a fracturing job without affecting the outcome of the fracturing job after proppant injection has been initiated.

Similarly, during well cementing jobs or well acidizing jobs, an interruption in the pumping process after pumping has begun greatly affects the outcome of the job.

While the present invention has been discussed in relation to fracturing, the system and method of the present invention are equally applicable to other operations such as well cementing, well drilling, chemical additive systems, water control pump systems, acidizing jobs and the like which have similar pump requirements.

The present invention offers great advantages in such operations. In particular, it is possible to determine at any given time during the operation whether any of the multiplex pumps have developed a defect. Even if one of the multiplex pumps has developed a defect, it is possible to continue the operation using the pump and monitor the defect. In the example above, the defective pump continued to pump effectively for over 40 minutes. This is frequently long enough to complete a fracture job after detection of the defect. By detecting the pump defects possibly even more than forty minutes in advance, it is possible to insure that, if all pumps are in good condition at the beginning of the fracturing job, the job will be completed without incident. The method of the present invention also allows early identification of which pump is defective in the pump system and allows the pump operator to save considerable time in troubleshooting the origin of a problem. The use of the system and method of the present invention provides greater reliability in the use of multiplex pumps in fracturing and other operations and reduces the need for excess or backup pump capacity. In other words, when it is possible to monitor the performance of the multiplex pumps used for the fracturing and other jobs, the need for backup pumps can be reduced since a much higher degree of reliability can be achieved with the existing multiplex pumps.

It is common practice to take as much as thirty to one hundred percent excess pumping capacity to the site for any fracturing job simply because of the need to replace defective pumps immediately in the event of pump failures. By the use of the present invention, the pumps used for the fracturing treatment can be monitored to determine whether defects have begun to develop prior to beginning the fracture job. The indication before the beginning of the job that the pumps are reliable and functioning properly provides a degree of confidence not previously available for fracturing treatment operations. This ability to determine the presence of defects permits shutting down a job at a point where no damage to the formation results and repairing the pump or adding an alternate pump at a point when the substitution can be made without disrupting the operation so that the first pump can be removed from the line. Considerable economic savings result from the reduction in the amount of pump capacity required for each fracturing treatment. The multiplex pumps are expensive and bulky and expensive to transport to the well sites which are frequently in remote locations.

The present invention further comprises a system for early detection of defects in a multiplex pump by monitoring the pressure fluctuations in a line in fluid communication with either the discharge or suction side of the multiplex pump and the pump frequency of the multiplex pump and transforming the pressure fluctuations in the time domain into the frequency domain where pump harmonics are apparent. The system comprises a pressure sensor in operative communication with the line, a tachometer in frequency sensing communication with the multiplex pump, and a computer programmed to convert the pressure fluctuation data and frequency to pump harmonic, amplitude and angle data to provide a signal indicative of pump defects. It is desirable that this system be designed to run in real time so that pump defects may be detected immediately.

Multiplex pumps having different numbers of cylinders or chambers, and multiplex pumps operating at different frequencies may be combined in the same pumping system. The analysis of the pump harmonics is as described above for each multiplex pump. The presence of only the Ni harmonics for each multiplex pump is indicative of normal operation. Other harmonics for the multiplex pump indicate a defect. A properly working multiplex pump will show its first apparent harmonic at the pump frequency times the number of cylinders or chambers. The use of different pumping frequencies (i.e., different pump speeds) for the different multiplex pumps will change the location of the harmonics for the respective pumps and cause the harmonic spikes to be shown at different frequency values on the graph. This allows identification of the harmonic spikes for numerous pumps using a single pressure sensor and monitor. Identification of which spike is produced by each pump is made by use of the reading from each pump tachometer.

Having thus described the present invention by reference to certain of its preferred embodiments, it is respectfully pointed out that the embodiments and the example shown are illustrative rather than limiting in nature and that many variations and modifications are possible within the scope of the present invention. Many such variations and modifications may appear obvious and desirable to those skilled in the art based upon the foregoing example and description of preferred embodiments.

What is claimed is:

1. A method for early detection of defects in positive displacement multiplex pumps in a pumping system comprising at least one multiplex pump containing N cylinders, where N is an integer equal to at least 2, and in fluid communication with a discharge line, said method comprising:

a) measuring pressure fluctuations in a line in fluid communication with said multiplex pump as a function of time;

b) determining pump harmonics in a frequency domain for said multiplex pump from said pressure fluctuations, said pump harmonics being indicative of pump defects in said multiplex pump; and c) generating at least one signal indicative of said pump defects.

2. The method of claim 1 wherein said line in fluid communication with said multiplex pump is a discharge line.

3. The method of claim 1 wherein said line in fluid communication with said multiplex pump is an inlet line.

4. The method of claim 1 wherein the presence of only Ni harmonics, where N is equal to the number of said cylinders in said multiplex pump and i is an integer, is indicative of no pump defects in said multiplex pump.

5. The method of claim 1 wherein the presence of other harmonics than said Ni harmonics is indicative of at least one pump defect in said multiplex pump.

6. The method of claim 1 wherein a plurality of multiplex pumps are included in said pumping system.

7. The method of claim 6 wherein said multiplex pumps operate at different frequencies.

8. The method of claim 7 wherein a signal indicative of pump frequency of each of said pumps is communicated to a computer to enable determination of which pump is associated with each set of pump harmonics.

9. The method of claim 7 wherein a visual signal indicative of the pump frequency for each pump is displayed.

10. The method of claim 1 wherein said multiplex pumps comprise multiplex pumps having different numbers of cylinders.

11. The method of claim 1 wherein said method includes determining at least a portion of the phase angles of said multiplex pump harmonics.

12. The method of claim 1 wherein said method includes determining the reference angle of a first harmonic for said multiplex pump, said reference angle of said first harmonic being indicative of which of said cylinders in said multiplex pump contains said pump defect and of the type of defect.

13. The method of claim 1 wherein said method includes determining the reference angle of additional harmonics, said reference angles of said additional harmonics being indicative of the type of defects in said multiplex pump.

14. The method of claim 12 wherein said reference angles are indicative of a pump defect which results in different flow patterns from the cylinders in said multiplex pump.

15. The method of claim 14 wherein said pump defect is a defective suction valve, a defective discharge valve, a priming problem or a packing leak.

16. The method of claim 5 wherein N is equal to 2 and wherein the presence of other harmonics than 2i harmonics is indicative of at least one pump defect in said pump.

17. The method of claim 4 wherein N is equal to 3 and wherein the presence of only 3i harmonics is indicative of no pump defects in said pump.

18. The method of claim 5 wherein N is equal to 3 and wherein the presence of other harmonics than 3i harmonics is indicative of at least one pump defect in said pump.

19. The method of claim 4 wherein N is equal to 4 and wherein the presence of only 4i harmonics is indicative of at least one pump defect in said pump.

20. The method of claim 5 wherein N is equal to 4 and wherein the presence of other harmonics than 4i harmonics is indicative of at least one pump defect in said pump.

21. The method of claim 4 wherein N is equal to 5 and wherein the presence of only 5i harmonics is indicative of no pump defects in said pump.

22. The method of claim 5 wherein N is equal to 5 and wherein the presence of other harmonics than 5i harmonics is indicative of at least one pump defect in said multiplex pump.

23. The method of claim 1 wherein said pumping system is used for well fracturing jobs, well cementing jobs, chemical additive systems, water control pump systems, and well acidizing jobs.

24. The method of claim 22 wherein said pumping system is used for fracturing jobs.

25. The method of claim 1 wherein a plurality of multiplex pumps are included in said pumping system and wherein the pump frequency is determined for each said multiplex pump.

26. A method for early detection of defects in positive displacement multiplex pumps in a pumping system comprising at least one multiplex pump containing N chambers, where N is an integer equal to at least 2, and in fluid communication with a discharge line, said method comprising:

a) measuring pressure fluctuations in a line in fluid communication with said multiplex pump as a function of time;

b) determining pump harmonics in a frequency domain for said multiplex pump from said pressure fluctuations, said pump harmonics being indicative of pump defects in said multiplex pump; and c) generating at least one signal indicative of said pump defects.

27. The method of claim 26 wherein said line in fluid communication with said multiplex pump is a discharge line.

28. The method of claim 26 wherein said line in fluid communication with said multiplex pump is an inlet line.

29. The method of claim 26 wherein the presence of only Ni harmonics, where N is equal to the number of said chambers in said multiplex pump and i is an integer, is indicative of no pump defects in said pump.

30. The method of claim 26 wherein the presence of other harmonics than said Ni harmonics is indicative of at least one pump defect in said multiplex pump.

31. The method of claim 26 wherein a plurality of multiplex pumps are included in said pumping system.

32. The method of claim 31 wherein a visual signal indicative of the pump frequency for each pump is displayed.

33. The method of claim 31 wherein said multiplex pumps operate at different frequencies and wherein a signal indicative of the pump frequency of each of said pumps is communicated to a computer to enable determination of which pump is associated with each set of pump harmonics.

34. The method of claim 26 wherein said multiplex pumps comprise multiplex pumps having different numbers of cylinders.

35. The method of claim 26 wherein said pumping system is used for well fracturing jobs, well cementing jobs, chemical additive systems, water control pump systems, and well acidizing jobs.

36. The method of claim 22 wherein said pumping system is used for fracturing jobs.

37. The method of claim 26 wherein said method includes determining at least a portion of the phase angles of said multiplex pump harmonics.

38. The method of claim 37 wherein said method includes determining the reference angle of a first harmonic for said multiplex pump, said reference angle of said first harmonic being indicative of which of said cylinders in said multiplex pump contains said pump defect and of the type of defect.

39. The method of claim 37 wherein said method includes determining the reference angle of additional harmonics, said reference angles of said additional harmonics being indicative of the type of defects in said multiplex pump.

40. The method of claim 26 wherein said reference angles are indicative of a pump defect which results in different flow patterns from the cylinders in said multiplex pump.

41. The method of claim 40 wherein said pump defect is a defective suction valve, a defective discharge valve, a priming problem or a packing leak.

42. The method of claim 30 wherein N is equal to 2 and wherein the presence of other harmonics than 2i harmonics is indicative of at least one pump defect in said pump.

43. The method of claim 29 wherein N is equal to 3 and wherein the presence of only 3i harmonics is indicative of no pump defects in said pump.

44. The method of claim 30 wherein N is equal to 3 and wherein the presence of other harmonics than 3i harmonics is indicative of at least one pump defect in said pump.

45. The method of claim 29 wherein N is equal to 4 and wherein the presence of only 4i harmonics is indicative of at least one pump defect in said pump.

46. The method of claim 30 wherein N is equal to 4 and wherein the presence of other harmonics than 4i harmonics is indicative of at least one pump defect in said pump.

47. The method of claim 29 wherein N is equal to 5 and wherein the presence of only 5i harmonics is indicative of no pump defects in said pump.

48. The method of claim 30 wherein N is equal to 5 and wherein the presence of other harmonics than 5i harmonics is indicative of at least one pump defect in said multiplex pump.

49. In a method for fracturing a subterranean formation penetrated by a wellbore by pumping a fracturing fluid at fracturing volume and pressure into said subterranean formation with at least one positive displacement multiplex pump, the improvement comprising:

a) measuring pressure fluctuations in a line in fluid communication with said multiplex pump;

b) determining pump harmonics in a frequency domain for said multiplex pump from said pressure fluctuations, said pump harmonics being indicative of pump defects in said multiplex pump; and c) generating at least one signal indicative of said pump defects.

50. The improvement of claim 49 wherein said multiplex pump is a plunger-and-cylinder pump.

51. The improvement of claim 49 wherein a plurality of multiplex pumps are used to pump said fracturing fluid.

52. The improvement of claim 49 wherein said signal is generated prior to fracturing said subterranean formation.

53. The improvement of claim 49 wherein said signal is generated prior to injecting proppant into said formation.

54. The improvement of claim 49 wherein multiplex pumps indicated as defective by said signal are repaired or replaced.

55. A system for early detection of defects in multiplex positive displacement pumps in a pumping system comprising at least one multiplex pump containing N positive displacement chambers, where N is an integer equal to at least 2, and in fluid communicative with a discharge line, said system comprising:

a) a pressure sensor operatively positioned in pressure sensing communication with a line in fluid communication with said pumping system;

b) a computer in operative communication with said pressure sensor and programmed to determine pump harmonics in a frequency domain for said at least one multiplex pump from pressure fluctuation in said line measured by said pressure sensor; and c) a display device in operative communication with said computer.

56. The system of claim 55 wherein said display comprises a monitor screen.

57. The system of claim 55 wherein said display comprises a printer.

58. The system of claim 55 wherein said pumping system includes a plurality of multiplex pumps.

59. The system of claim 55 wherein said pressure sensor is positioned in pressure sensing communication with a discharge line.

60. The system of claim 55 wherein said pressure sensor is positioned in pressure sensing communication with an inlet line.

61. The system of claim 55 wherein the relative amplitude of said pump harmonics is indicative of the amount of leakage through a valve or packing.

62. The system of claim 55 wherein the relative amplitude of said pump harmonics is indicative of the pump volumetric efficiency.

63. The system of claim 55 wherein the relative amplitude of said pump harmonics is indicative of the amount of gas in a pump cylinder due to lack of priming, entrained air or cavitation.

64. The system of claim 55 wherein said system includes a tachometer in frequency sensing communication with said at least one multiplex pump and in frequency transmitting communication with said computer.

* * * * *

UNITED STATES PATENT AND TRADEMARK OFFICE

CERTIFICATE OF CORRECTION

PATENT NO. : 5,720,598

DATED : February 24, 1998

INVENTOR(S) : Yan Kuhn de Chizelle

It is certified that error appears in the above-identified patent and that said Letters Patent is hereby corrected as shown below:

On the title page, item [75], should read as follows:

Yan Kuhn de Chizelle, Missouri City, Texas.

Signed and Sealed this

Twenty-seventh Day of October, 1998

*Attest:*

Bruce Lehman

BRUCE LEHMAN

*Attesting Officer*

*Commissioner of Patents and Trademarks*